US005328357A

United States Patent [19]

Riehl

[11] Patent Number: 5,328,357

[45] Date of Patent: Jul. 12, 1994

[54] BURNER CONSTRUCTION AND METHOD OF MAKING THE SAME

[75] Inventor: Fred Riehl, Greensburg, Pa.

[73] Assignee: Robertshaw Controls Company, Richmond, Va.

[21] Appl. No.: 976,486

[22] Filed: Nov. 16, 1992

[51] Int. Cl.[5] ..... F23Q 3/00

[52] U.S. Cl. ..... 431/266; 431/264; 431/354; 126/39 R; 126/39 E; 29/890.02

[58] Field of Search ..... 431/266, 264, 263, 355, 431/354; 239/553.3, 567, 390, 396, 552, 568; 126/39 R, 39 E, 39 N, 39 F, 39 K; 29/400.1, 890.02

[56] References Cited

U.S. PATENT DOCUMENTS

| | | | |
|---|---|---|---|
| 4,757,801 | 7/1988 | Le Monnier de Gouville et al. | 126/39 H |
| 4,968,246 | 11/1990 | Sasada et al. | 126/39 K X |
| 5,002,038 | 3/1991 | Riehl | 431/266 X |
| 5,040,970 | 8/1991 | Riehl | 431/264 |
| 5,083,915 | 1/1992 | Riehl | 126/39 E X |
| 5,112,218 | 5/1992 | Sigler | 431/266 |
| 5,125,390 | 6/1992 | Riehl | 126/39 H X |
| 5,133,334 | 7/1992 | Riehl | 126/39 R |
| 5,149,262 | 9/1992 | Riehl | 431/258 X |
| 5,160,255 | 11/1992 | Sigler | 126/39 E X |
| 5,160,256 | 11/1992 | Riehl | 431/266 |

OTHER PUBLICATIONS

Prior known burner construction having straight small grooves for carry-over flames.

*Primary Examiner*—Larry Jones

*Attorney, Agent, or Firm*—Candor, Candor & Tassone

[57] ABSTRACT

A burner construction and method of making the same are provided, the burner construction comprising a burner body having a chamber therein and a removable cap closing one end of the burner body, one of the burner body and the cap having an annular surface interrupted by a plurality of radially disposed main grooves that are spaced apart by lands of the annular surface and that define a generally repeating pattern of a set of a certain number of the main grooves and the lands separated from the next adjacent set of the certain number of the main grooves and the lands by one of the lands that is not part of the sets and that has an annular length that is longer than the annular length of any one of the lands of the sets separated thereby, the free end surface of each land that is not part of the sets having a small radially disposed and substantially Y-shaped groove therein that is closed on one end thereof by an annular surface of the other of the burner body and the cap to provide small carry-over flames between the sets of main grooves adjacent that respective land that is not part of the sets.

20 Claims, 6 Drawing Sheets

BURNER CONSTRUCTION AND METHOD OF MAKING THE SAME

BACKGROUND OF THE INVENTION

1. Field of the Invention

This invention relates to a new burner construction and to a new method of making such a burner construction.

2. Prior Art Statement

It is known to provide a burner construction comprising a burner body means having a chamber means therein and having opposed end means one of which is open to the chamber means and the other of which has means for interconnecting a source of fuel to the chamber means, and a removable cap means closing the one end means of the body means, the burner construction having main port means interconnecting the chamber means to the exterior of the burner construction and through which the fuel can issue to burn externally to the burner construction, one of the body means and the cap means having an annular surface means interrupted by a plurality of radially disposed main groove means that are spaced apart by land means of the annular surface means and that define a generally repeating pattern of a set of a certain number of the main groove means and the land means separated from the next adjacent set of the certain number of the main groove means and the land means by one of the land means that is not part of the sets and that has an annular length that is longer than the annular length of any one of the land means of the sets separated thereby, the other of the body means and the cap means having an annular surface means cooperating with the annular surface means that has the main groove means therein to close the main groove means on one end thereof whereby the main groove means define the main port means, each land means having a free end surface means that faces the annular surface means of the other of the body means and the cap means, the free end surface means of the land means that are not part of the sets each being spaced from the annular surface means of the other of the body means and the cap means to provide for small carry-over flame means between the sets of main groove means adjacent that respective land means that is not part of the sets. For example, see the Riehl U.S. Pat. No. 5,040,970.

Also see the Riehl U.S. Pat. No. 5,133,334 and the Sigler U.S. Pat. No. 5,112,218 for similar burner constructions.

It is also known to provide a burner construction comprising a burner body means having a chamber means therein and having opposed end means one of which is open to the chamber means and the other of which has means for interconnecting a source of fuel to the chamber means, and a removable cap means closing the one end means of the body means, the burner construction having main port means interconnecting the chamber means to the exterior of the burner construction and through which the fuel can issue to burn externally to the burner construction, one of the body means and the cap means having an annular surface means interrupted by a plurality of radially disposed main groove means that are spaced apart by land means of the annular surface means, each land means being of the same annular length, the other of the body means and the cap means having an annular surface means cooperating with the annular surface means that has the main groove means therein to close the main groove means on one end thereof whereby the main groove means define the main port means, each land means having a free end surface means that faces the annular surface means of the other of the body means and the cap means, the free end surface means of the land means each having small radially disposed groove means therein that leads from the chamber means to the exterior of the burner construction and that is closed on one end thereof by the annular surface means of the other of the body means and the cap means to provide small carry-over flame means between the main groove means adjacent that respective land means, each small groove means being substantially uniform throughout the length thereof.

SUMMARY OF THE INVENTION

It is one of the features of this invention to provide a new burner construction that provides a carryover flame means that assures reliable communication and with minimum interference of the main burner port flames with the critical secondary air circulation.

In particular, it has been found according to the teachings of this invention that when providing for the small carry-over flame means by the method and structure set forth in the aforementioned Riehl U.S. Pat. No. 5,040,970, wherein the land means between adjacent sets of main ports each has an end surface means spaced from an annular surface means of the cap means of the burner construction, close tolerances must be maintained between the annular surface means of the cap means and the spaced end surface means of the carry-over land means in order to assure proper flame propagation and to prevent flashback problems.

It was also found according to the teachings of this invention that when making the end surface means of all of the land means of the annular surface means that have the main groove means therein to be engaged by the annular surface means on the other part of the burner construction assembled therewith with the end surface means of each land means that separates the sets of main ports from each other having small groove means therein to provide small carryover flame means between the sets of main ports adjacent that particular land means, the forming of each small groove means with a uniform cross section throughout the length thereof as in the prior known arrangement did not result in a performance that was as good as when each small groove means is formed with a Y-shape in the manner of this invention so as to assure reliable communication and with minimum interference of the burner port flames with the critical secondary air circulation.

For example, one embodiment of this invention comprises a burner construction comprising a burner body means having a chamber means therein and having opposed end means one of which is open to the chamber means and the other of which has means for interconnecting a source of fuel to the chamber means, and a removable cap means closing the one end means of the body means, the burner construction having main port means interconnecting the chamber means to the exterior of the burner construction and through which the fuel can issue to burn externally to the burner construction, one of the body means and the cap means having an annular surface means interrupted by a plurality of radially disposed main groove means that are spaced apart by land means of the annular surface means and that define a generally repeating pattern of a set of a certain number of the main groove means and the land means separated from the next adjacent set of the certain number of the main groove means and the land means by one of the land means that is not part of the sets and that has an annular length that is longer than the annular length of any one of the land means of the sets separated thereby, the other of the body means and the cap means having an annular surface means cooperating with the annular surface means that has the main groove means therein to close the main groove means on one end thereof whereby the main groove means define the main port means, each land means having a free surface means that faces the annular surface means of the other of the body means and the cap means, the free end surface means of the land means that are not part of the sets each having small radially disposed groove means therein that leads from the chamber means to the exterior of the burner construction and that is closed on one end thereof by the annular surface means of the other of the body means and the cap means to provide small carry-over flame means between the sets of main groove means adjacent that respective land means that is not part of the sets, each small groove means having an inner end and an outer end, the outer end of each small groove means being wider than the inner end thereof.

Accordingly, it is an object of this invention to provide a new burner construction having one or more of the novel features of this invention as set forth above or hereinafter shown or described.

Another object of this invention is to provide a new method of making such a burner construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
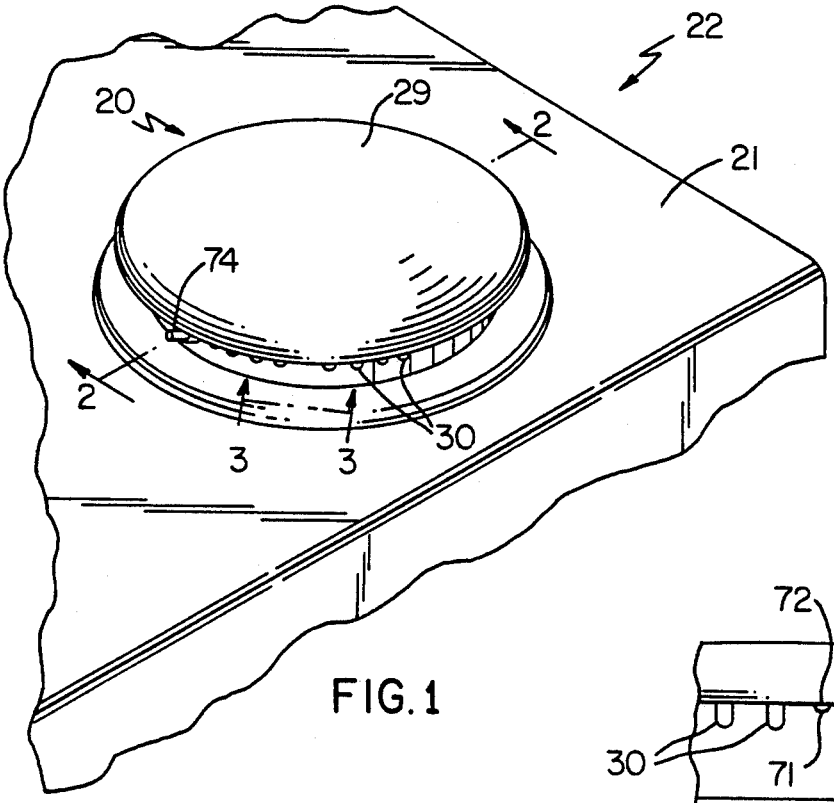
FIG. 1 is a fragmentary top perspective view illustrating a burner construction mounted in a range top of a cooking apparatus.

While the various features of this invention are hereinafter illustrated and described as being particularly adapted to provide a burner construction for being sealed into the range top of a cooking apparatus, it is to be understood that the various features of this invention can be utilized singly or in various combinations thereof to provide a burner construction for other apparatus as desired.

Therefore, this invention is not to be limited to only the embodiments illustrated in the drawings, because the drawings are merely utilized to illustrate one of the wide variety of uses of this invention.

The burner constructions of this invention are of types that are similar to the burner constructions that are respectively set forth in applicant's aforementioned issued U.S. Pat. Nos. 5,133,334 and 5,040,970, whereby these two U.S. patents are being incorporated into this disclosure by this reference thereto. In addition, the burner constructions of this invention utilize an igniter assembly that is fully disclosed in the aforementioned Sigler U.S. Pat. No. 5,112,218, whereby this U.S. patent is also being incorporated into this disclosure by this reference thereto.

Referring now to FIGS. 1–6, a burner construction having known carry-over groove means therein is generally indicated by the reference numeral 20 and is illustrated as being sealed to a range top surface 21 of a cooking apparatus that is generally indicated by the reference numeral 22, the burner construction 20 comprising a burner body means 23 having a chamber means 24 therein and having opposed end means 25 and 26 with the end means 25 being open to the chamber means 24 and the other end means 26 being closed and having means that is generally indicated by the reference numeral 27 for interconnecting a source 28 of fuel with the chamber means 24 in a manner hereinafter set forth.

The burner construction 20 also comprises a removable cap means 29 closing the open end means 25 of the burner body means 23, the burner construction having a plurality of main port means 30 interconnecting the chamber means 24 to the exterior of the burner construction 20 and through which fuel can issue to burn externally to the burner construction 20 in a manner well known in the art. The burner body means 23 and the removable cap means 29 of the burner construction 20 can be formed of any suitable material or combination of materials, such as metallic material, as is also well known in the art.

Figure 4:
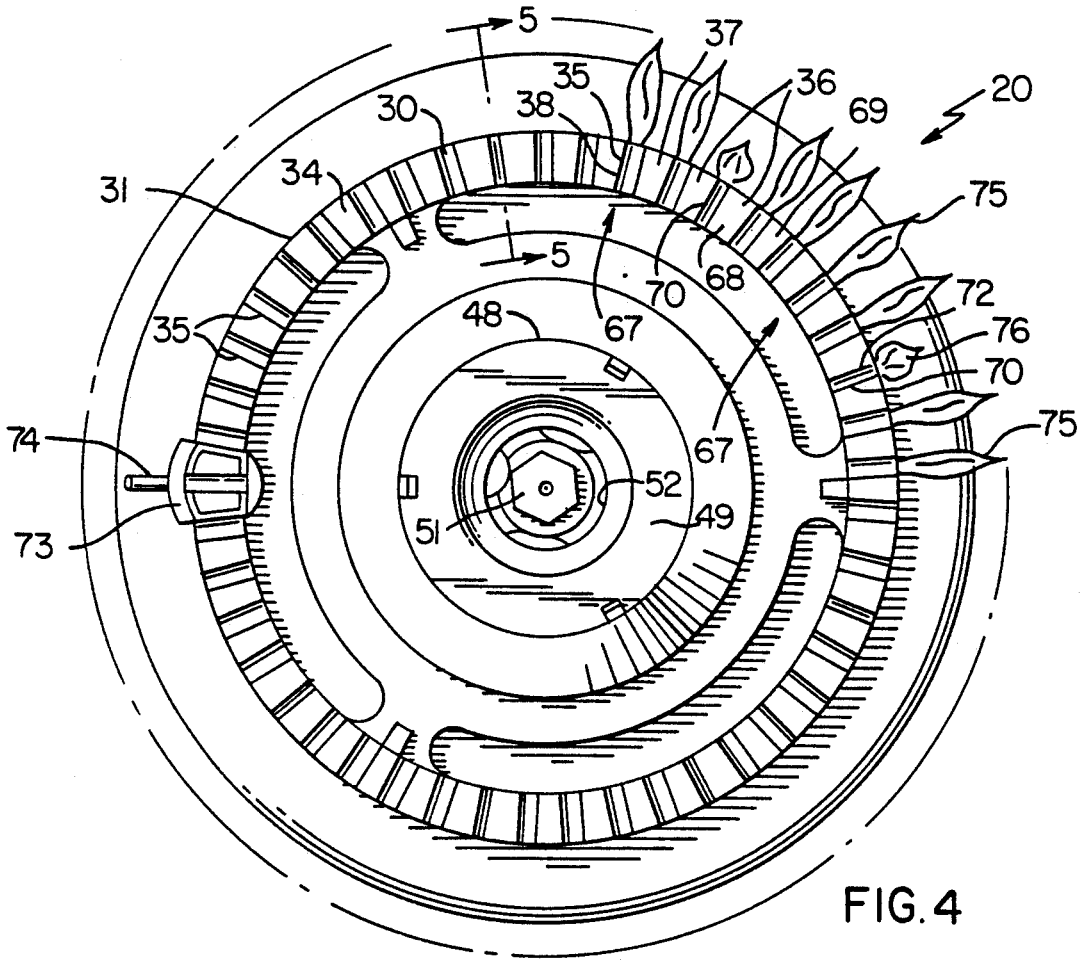
FIG. 4 is a top view of the burner construction of FIG. 2 with the cap means thereof removed and schematically illustrating the flame pattern produced by the various port means of the burner construction when the same has the cap means mounted thereon, FIG. 4 being taken generally in the direction of the arrows 4—4 of FIG. 2.
Figure 5:
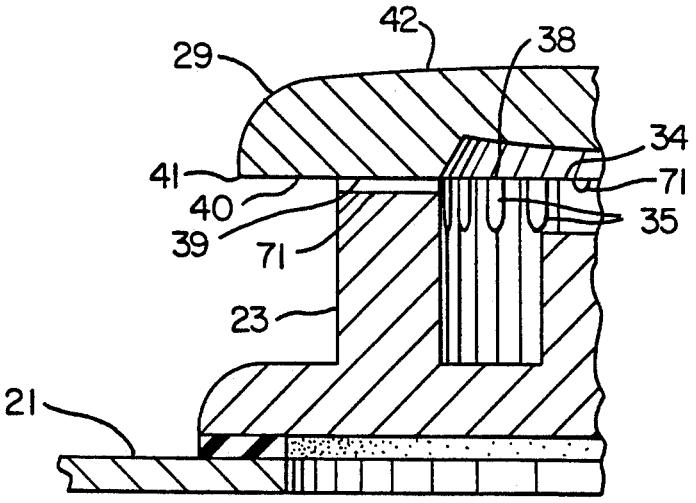
FIG. 5 is an enlarged fragmentary cross-sectional view taken in the direction of the arrows 5—5 of FIG. 4.
Figure 6:
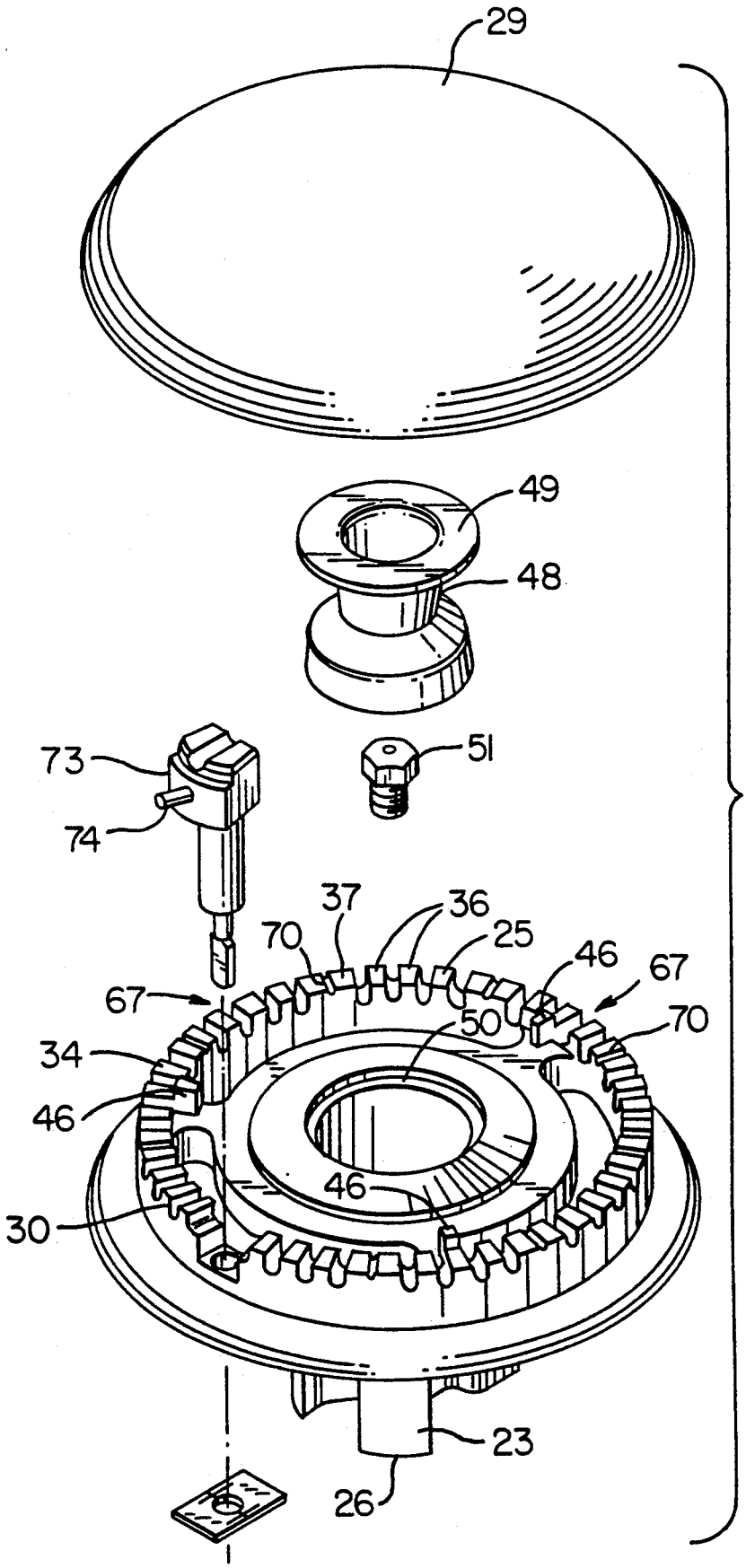
FIG. 6 is an exploded perspective view of the various parts of the burner construction of FIGS. 1–5.
Figure 7:
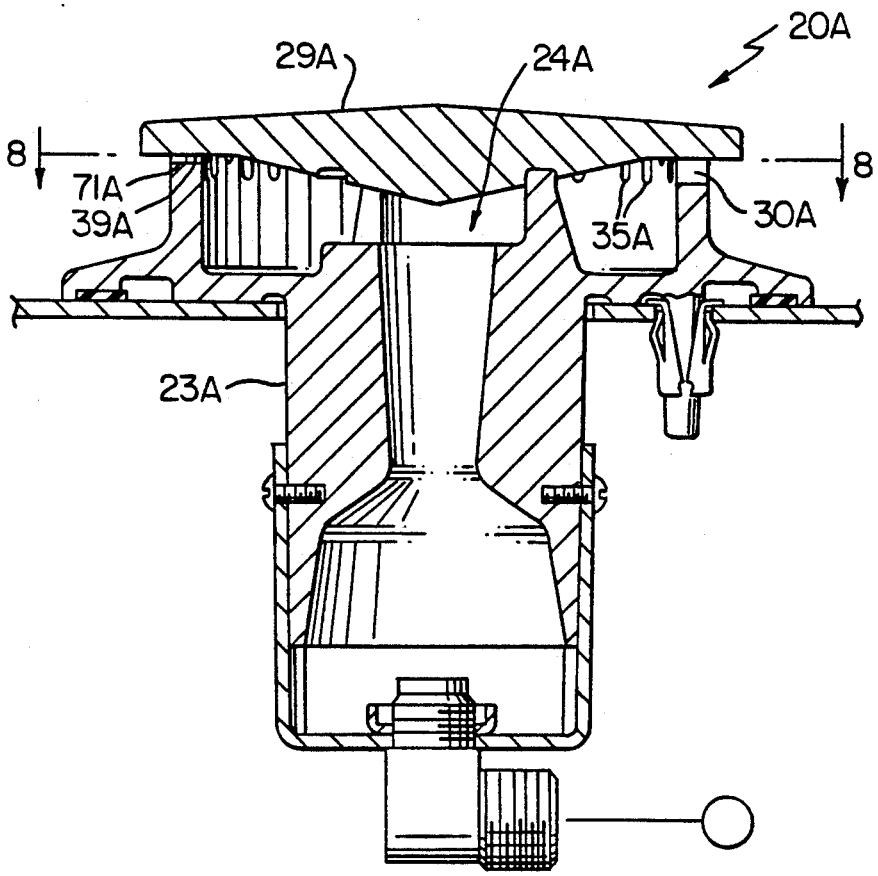
FIG. 7 is a view similar to FIG. 2 and illustrates the burner construction of this invention.

The body means 23 has an annular wall 31 provided with an annular substantially flat top surface 34 interrupted by a plurality of radially disposed and spaced apart U-shaped main grooves 35 disposed in the circular array pattern as illustrated in FIGS. 4 and 6, the main groove means 35 being separated by land means 36 and 37 of the annular surface means 34 which do not have the main grooves 35 therein.

The main grooves 35 in the body member 23 are adapted to be closed at the open ends 38 thereof by a substantially flat annular surface means 39 formed on a side 40 of the cap means 29 when the cap means 29 is disposed in the closing position on the open end 25 of the body means 23 in the manner illustrated in FIGS. 1, 2, 3 and 5 so as to cooperate with the main grooves 35 to define the main port means 30 previously set forth.

The cap means 29 has an annular peripheral edge means 41 that interconnects the side 40 of the cap means 29 with an opposed side 42 thereof, the side 42 being generally conical and the side 40 also having a central conical portion 43 that has its larger base 44 joining with the flat annular portion 39 by an angled surface means 45 which is adapted to engage against a plurality of upwardly standing abutments 46 of the body member 23 so as to orient the cap 29 in its rotational position on the end 25 of the body means 23 so that the annular surface means 39 thereof will close the main U-shaped grooves 35 to form the main ports 30 as previously set forth.

Figure 2:
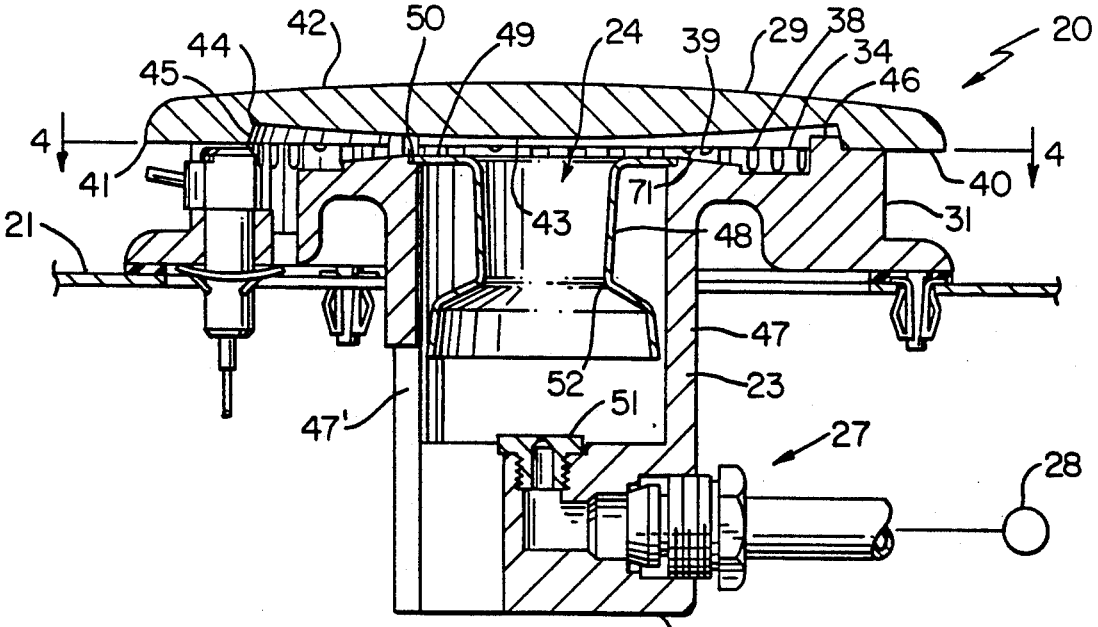
FIG. 2 is an enlarged fragmentary cross-sectional view taken on line 2—2 of FIG. 1.

The chamber means 24 of the body member 23 has a cylindrical portion 47 in which a removable venturi member 48 is disposed and has an upper annular flange means 49 that rests on an annular shoulder means 50 of the body means 23 as illustrated in FIG. 2 so that the flow of fuel out of an orifice means 51 must pass through a throat 52 of the venturi member 48 before the same can reach the chamber means 24 to pass out through the main ports 30 all for the reasons fully set forth in the aforementioned Riehl U.S. Pat. No. 5,133,334, the flow of fuel through the venturi member 48 drawing primary air through opening means 47' in the wall 47 to mix with the fuel also in a manner well known in the art.

The main groove means 35 that are formed in the wall 31 of the burner body means 23 to subsequently form the main port means 30 are so constructed and arranged that the same define a substantially repeating pattern of a set 67, FIG. 4, of four main grooves 35 separated from each other by land means 38 and then separated from the next set 67 of four main grooves 35 and their intermediate land means 37 by a large land means 36 that has an annular length or circumferential length greater than the annular or circumferential length of each of the lands 37 of the two adjacent sets 67 as illustrated. In addition, the separating lands 36 each has a free end flat surface means 68 that is coplanar with free end flat surface means 69 of the lands 37 so that it can be seen that the free end surface means 68 and 69 are a continuation of the flat annular surface 34 of the burner body means 23 with the surface means 68 of the lands 36 not being recessed below the surface means 69 of the lands 37 as in the aforementioned Riehl U.S. Pat. No. 5,040,970 and the aforementioned Sigler U.S. Pat. No. 5,112,218.

Figure 3:
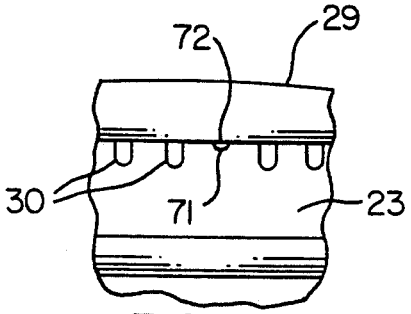
FIG. 3 is an enlarged fragmentary view looking toward the main port means of the burner construction of FIG. 1 and is taken generally in the direction of the arrows 3—3 of FIG. 1.

Instead, the end surface means 68 of each large land 36 is interrupted by a small U-shaped groove 70 that passes through the central part of the free end surface means 68 thereof so as to interconnect the chamber 24 of the burner body means 23 to the exterior of the burner construction 20 and to form a carry-over port 71, FIG. 3, when its open end 72 is closed by the annular surface means 39 of the end cap means 29 as illustrated.

In this manner, the fuel being directed to the chamber means 24 of the burner construction 20 passes out through the main burner ports 30 to be ignited by an igniter assembly 73 that creates sparks between an electrode 74 thereof and the end cap means 29 in the manner fully set forth in the aforementioned Sigler U.S. Pat. No. 5,112,218 to create main flames 75 at the burner ports 30 adjacent the igniter means 73 with the flame means 75 being propagated around the burner construction 20 from port 30 to port 30 and then by small carry-over flames 76 between adjacent sets 67 of ports 30 to the next set 67 of ports 30 in a manner similar to the flame propagation provided by the lowered larger lands in the aforementioned Riehl U.S. Pat. No. 5,040,970.

In one working embodiment of the sealed burner construction 20, the main grooves 35 each has a width at the open end 38 thereof of approximately 0.062 of an inch and a depth of approximately 0.115 of an inch while the rounded end of the U-shape thereof is defined by a radius that is approximately one-half of the width of the respective grooves 35. The annular or circumferential length of the end surface means 68 of each large separating land 36 is approximately 0.315 of an inch and the annular or circumferential length of the end surface means 69 of each land 37 of the sets 67 is approximately 0.125 of an inch. Each small groove 70 has a width at the open end 72 thereof of approximately 0.046 of an inch and a depth of approximately 0.025 of an inch with the rounded end of the U-shape thereof having a radius that is approximately one-half of the width of the open end 72 thereof. The length of the large grooves 35 and the small grooves 70 is approximately 0.125 of an inch. However, it was found that such carry-over groove means 70 did not perform satisfactorily.

A burner construction of this invention is generally indicated by the reference numeral 20A in FIGS. 7–10 and parts thereof similar to the parts of the burner construction 20 previously described are indicated by like reference numerals followed by the reference letter "A".

As illustrated in FIGS. 7–10, it can be seen that the burner construction 20A of this invention is substantially identical to the burner construction set forth in the aforementioned Riehl U.S. Pat. No. 5,040,970 except that the large lands 36A thereof have the top surface means 68A thereof disposed in the same plane as the top surface means 69A of the smaller lands 37A that separate adjacent main grooves 35A from each other whereby all of the surface means 68A and 69A of the lands 36A and 37A are engaged by the annular flat surface means 39A of the end cap means 29A when the same is disposed on the burner body means 23A in the manner illustrated in FIGS. 7 and 9 to close the open ends 38A of the main grooves 35A to form the main ports 30A of the burner construction 20A.

The large lands 36A each has a carry-over small groove means 70A formed in the center portion thereof and leading from the chamber 24A of the burner construction 20A to the exterior thereof to produce the small carry-over flames 76A between the sets of large main flames 75A for the reasons previously set forth for the carry-over grooves 70.

Figure 9:
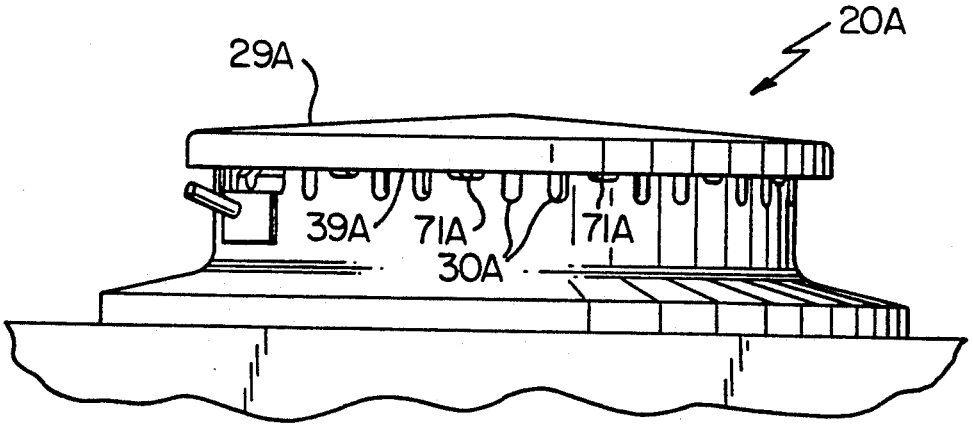
FIG. 9 is a fragmentary side view of the burner construction of FIG. 7.

However, the carry-over grooves 70A of the burner construction 20A each define a substantially Y-shape at the open end 72A thereof whereby a substantially straight leg 80 of each small groove 70A interconnects with the chamber 24A of the burner body means 23A and is substantially of the same size and U-shape as the groove 70 previously described whereas a funnel-shaped portion 81 of the groove 70A increases in size as the same approaches the exterior of the burner construction 20A to provide a relatively large outlet end 82 which forms a relatively shallow and wide carry-over port 71A when that groove 70A is closed by the surface means 39A of the end cap means 29A as illustrated in FIG. 9.

While each carry-over groove 70A can have any suitable dimensions, it is believed that the same can have a depth of approximately 0.025 of an inch throughout the entire approximate 0.125 of an inch length thereof and have a width at the open end 72A at the inner substantially straight leg portion 80 thereof of approximately 0.046 of an inch while the funnel-shaped portion 81 at the juncture of the open end 72A and the outer end 82 thereof has a width of approximately 0.125 of an inch. The straight leg portion 80 of each small groove 70A has dimensions substantially the same as the grooves 70 previously described and has a length of approximately 0.062 of an inch.

The main grooves 35A can have the same dimensions as the grooves 35 previously described.

In this manner, it is believed that the Y-shaped carry-over ports 70A permit close control of the carry-over fuel leaving the chamber 24A through the straight portion 80 of each carry-over port 70A and then is gradually spread out to exit along the outer width 82 of the angled portion 81 of that carry-over groove 70A to spread the carry-over flame 76A over a greater arcuate distance so as to require a minimum of controlled fuel injection between the sets 67A of main ports 30A for carry-over flame purposes.

However, it is to be understood that it is believed that the burner construction 20 previously described for FIGS. 1-6 could have carry-over grooves in the large lands 36 thereof that are substantially identical to the carry-over grooves 70A previously described for the burner construction 20A of this invention.

Figure 11:
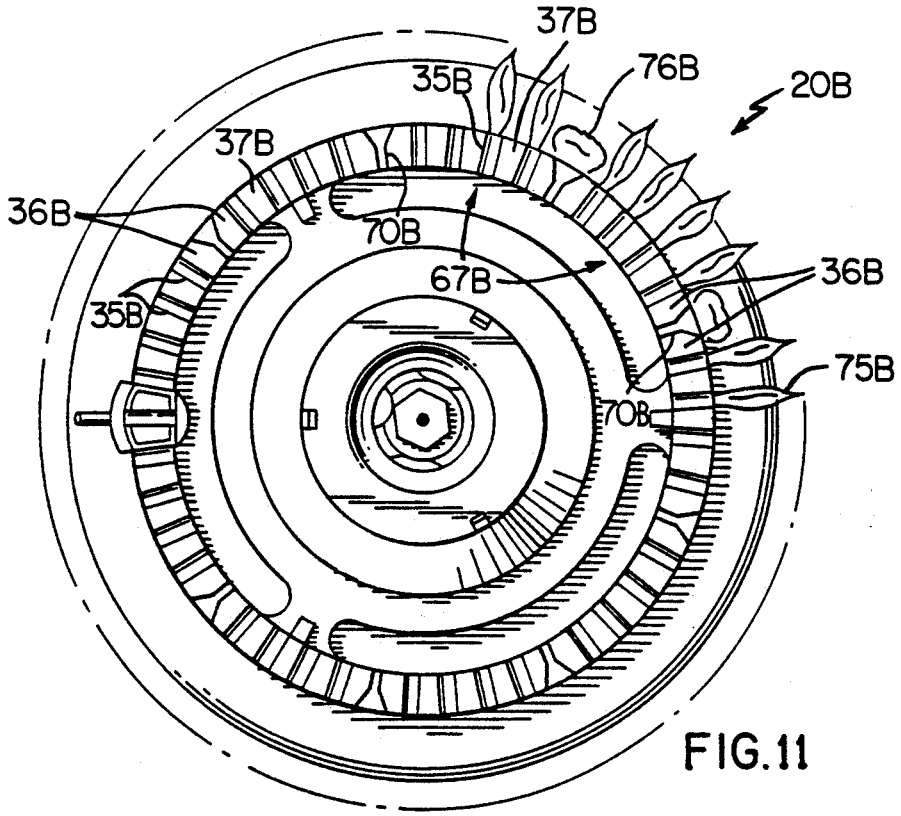
FIG. 11 is a view similar to FIG. 8 and illustrates another burner construction of this invention that is similar to the burner construction of FIGS. 1–6 and having the carryover grooves of the burner construction of FIGS. 7–10.
Figure 8:
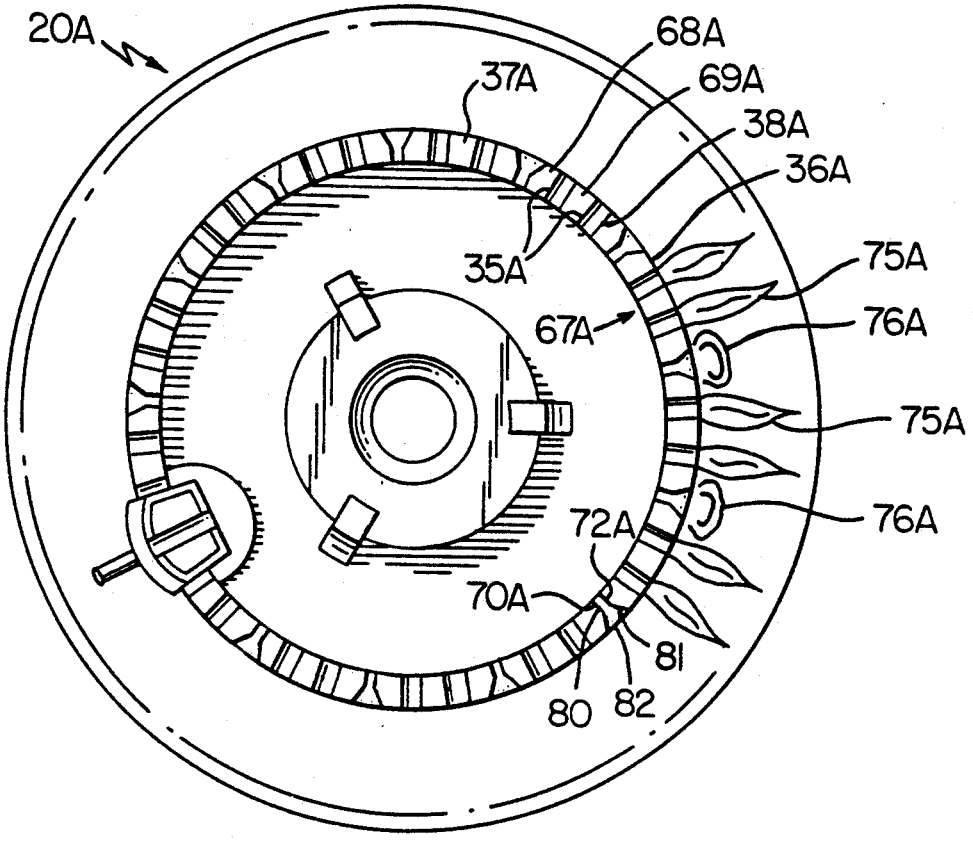
FIG. 8 is a top view of the burner construction of FIG. 7 with the cap means removed and schematically illustrating the flame pattern produced by the ports of the burner construction when the cap means is in place, FIG. 8 being taken generally in the direction of the arrows 8—8 of FIG. 7.

For example, reference is now made to FIG. 11 wherein another burner construction of this invention is generally indicated by the reference numeral 20B and parts thereof similar to the burner constructions 20 and 20A previously described are indicated by like reference numerals followed by the reference letter "B".

As illustrated in FIG. 11, the burner construction 20B is identical to the burner construction 20 previously described except that the large lands 36 each has a carryover groove 70B formed therein and being identical to the grooves 70A of the burner construction 20A previously described so as to produce the small carry-over flames 76B in the same manner as the carry-over flames 76A previously set forth.

However, it can be seen that in the burner construction 20A, each set 67A of main grooves 35A comprises only two such grooves 35A separated by a single small land 37A whereas in the burner constructions 20 and 20B previously set forth, each set 67 or 67B comprises four main grooves 35 or 35B and three small lands 37 or 37B whereby it can be seen that any desired pattern of main grooves and carry-over grooves can be utilized. For example, more than one carry-over small groove per large land can be utilized, if desired.

However, it is to be understood that by minimizing the carry-over flame size, the induction of secondary air to the main ports of the burner construction is improved and the main burner ports can burn with improved combustion. Also, the dimensions of the carry-over ports can be modified to suit the geometric design of the port pattern required.

It is also to be understood that each carry-over area of each burner construction can be selected so as to be located adjacent a leg of a burner grate that is set over the particular burner construction to hold a pot or the like above that burner construction so that such grate leg will likewise not interfere with the induction of secondary air to the main burner ports.

Therefore, it can be seen that in each burner construction of this invention the annular surface of the burner body means that has the main groove means formed therein does not have the large lands thereof reduced in height as in the aforementioned Riehl U.S. Pat. No. 5,040,970 so that the end surfaces of the large lands are contacted by the annular surface of the end cap means in the same manner that the end surfaces of the smaller lands are contacted thereby and each large land has a small Y-shaped carry-over groove formed therein to be closed by that end surface means of the end cap means to produce a carry-over port for the purposes previously set forth. It ism believed that by such carry-over construction of this invention, fabrication tolerances are less critical to ensure proper flame propagation and prevent flashback problems.

Figure 10:
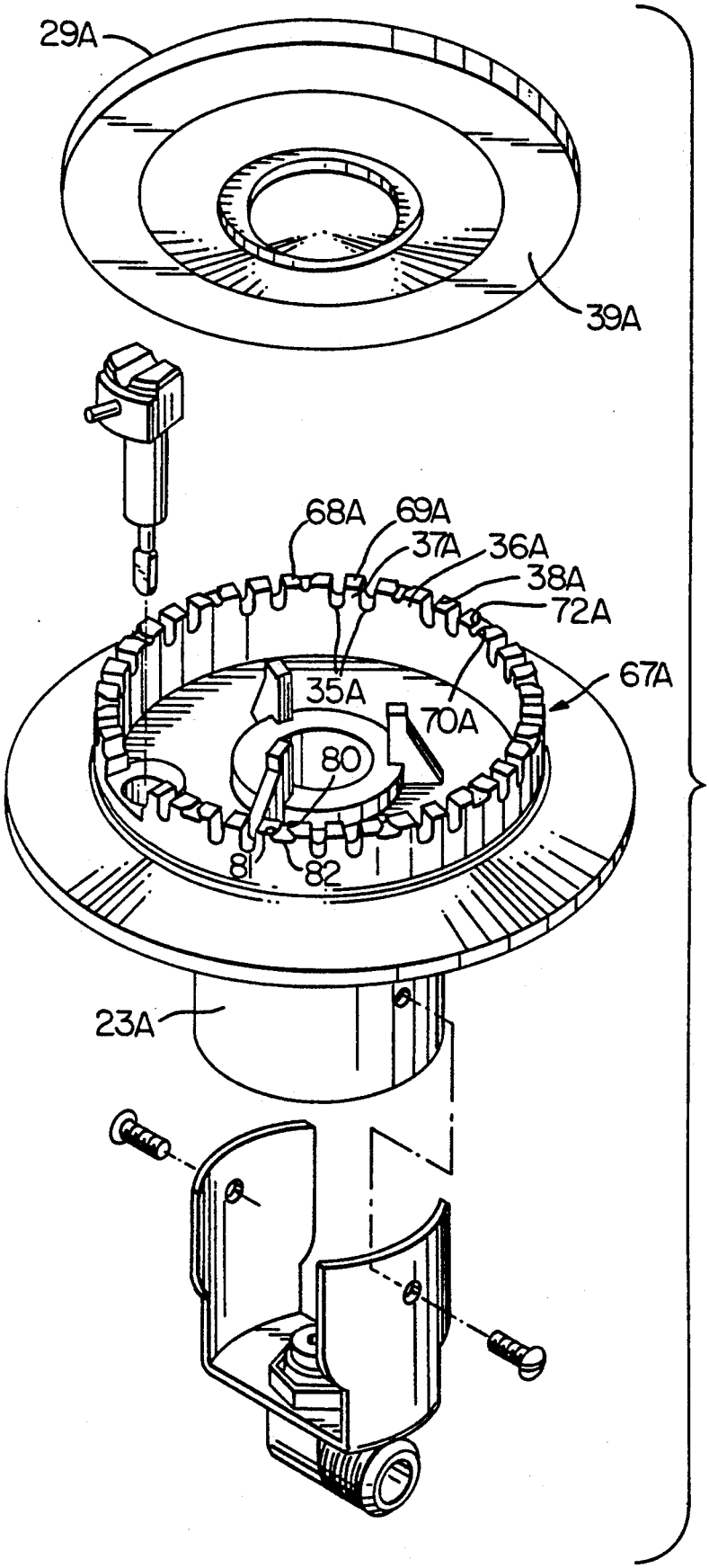
FIG. 10 is an exploded perspective view of the various parts of the burner construction of FIGS. 7–9.

While the main grooves and small carry-over grooves have been illustrated and described as being formed in the annular surface of the burner body means, it is to be understood that such grooves could be formed in the end cap means to be closed by the annular surface of the burner body means as set forth in FIGS. 9 and 10 of the aforementioned Riehl U.S. Pat. No. 5,133,334, if desired.

Therefore, it can be seen that this invention not only provides a new burner construction, but also this invention provides a new method of making such a burner construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a burner construction comprising a burner body means having a chamber means therein and having opposed end means one of which is open to said chamber means and the other of which has means for interconnecting a source of fuel to said chamber means, and a removable cap means closing said one end means of said body means, said burner construction having main port means interconnecting said chamber means to the exterior of said burner construction and through which said fuel can issue to burn externally to said burner construction, one of said body means and said cap means having an annular surface means interrupted by a plurality of radially disposed main groove means that are spaced apart by land means of said annular surface means and that define a generally repeating pattern of a set of a certain number of said main groove means and said land means separated from the next adjacent set of said certain number of said main groove means and said land means by one of said land means that is not part of said sets and that has an annular length that is longer than the annular length of any one of said land means of said sets separated thereby, the other of said body means and said cap means having an annular surface means cooperating with said annular surface means that has said main groove means therein to close said main groove means on one end thereof whereby said main groove means define said main port means, each said land means having a free end surface means that faces said annular surface means of the other of said body means and said cap means, the improvement wherein said free end surface means of said land means that are not part of said sets each has a small radially disposed groove means therein that leads from said chamber means to the exterior of said burner construction and that is closed on one end thereof by said annular surface means of said other of said body means and said cap means to provide small carry-over flame means between said sets of main groove means adjacent that respective land means that is not part of said sets, each said small groove means having an inner end and an outer end, said outer end of each said small groove means being wider than said inner end thereof.

2. A burner construction as set forth in claim 1 wherein each said small groove means has an open end and a closed end, each said small groove means having a depth of approximately 0.025 of an inch between said open end and said closed end thereof and from said inner end thereof to said outer end thereof, each said small groove means having a width of approximately 0.125 of an inch at the juncture of said outer end thereof with said open end thereof and a width of approximately 0.046 of an inch at the juncture of said inner end thereof with said open end thereof.

3. A burner construction as set forth in claim 2 wherein each said main groove means has an open end and a closed end, each said main groove having a depth of approximately 0.115 of an inch between said open end and said closed end thereof and having a width of approximately 0.062 of an inch at said open end thereof.

4. A burner construction as set forth in claim 1 wherein each said small groove means has an open end and a closed end, said open end of each said small groove means defining a generally Y-shaped configuration so as to have a generally straight leg inner portion and a generally funnel-shaped outer portion.

5. A burner construction as set forth in claim 4 wherein said straight leg inner portion of each said small groove means has a uniform transverse cross-sectional configuration throughout the length thereof.

6. A burner construction as set forth in claim 5 wherein said uniform transverse cross-sectional configuration is a substantially U-shape and thereby having an open end and a rounded closed end.

7. A burner construction as set forth in claim 6 wherein said straight leg inner portion of each said small groove means has a width of approximately 0.046 of an inch at said open end thereof and a depth of approximately 0.025 of an inch between said open end and said closed end thereof.

8. A burner construction as set forth in claim 7 wherein each said small groove means has a length of approximately 0.125 of an inch.

9. A burner construction as set forth in claim 8 wherein said closed end of said straight leg inner portion of each small groove means is defined by a radius of approximately 0.023 of an inch.

10. A burner construction as set forth in claim 1 wherein each said free end surface means of said land means that are not part of said sets has only one of said small groove means therein and that said one small groove means is disposed in the center of its respective land means.

11. In a method of making a burner construction comprising a burner body means having a chamber means therein and having opposed end means one of which is open to said chamber means and the other of which has means for interconnecting a source of fuel to said chamber means, and a removable cap means closing said one end means of said body means, said burner construction having main port means interconnecting said chamber means to the exterior of said burner construction and through which said fuel can issue to burn externally to said burner construction, one of said body means and said cap means having an annular surface means interrupted by a plurality of radially disposed main groove means that are spaced apart by land means of said annular surface means and that define a generally repeating pattern of a set of a certain number of said main groove means and said land means separated from the next adjacent set of said certain number of said main groove means and said land means by one of said land means that is not part of said sets and that has an annular length that is longer than the annular length of any one of said land means of said sets separated thereby, the other of said body means and said cap means having an annular surface means cooperating with said annular surface means that has said main groove means therein to close said main groove means on one end thereof whereby said main groove means define said main port means, each said land means having a free end surface means that faces said annular surface means of the other of said body means and said cap means, the improvement comprising the steps of forming said free end surface means of said land means that are not part of said sets to each have a small radially disposed groove means therein that leads from said chamber means to the exterior of said burner construction and that is closed on one end thereof by said annular surface means of said other of said body means and said cap means to provide small carry-over flame means between said sets of main groove means adjacent that respective land means that is not part of said sets, forming each said small groove means to have an inner end and an outer end, and forming said outer end of each said small groove means to be wider than said inner end thereof.

12. A method of making a burner construction as set forth in claim 11 and including the steps of forming each said small groove means to have an open end and a closed end, forming each said small groove means to have a depth of approximately 0.025 of an inch between said open end and said closed end thereof and from said inner end thereof to said outer end thereof, and forming each said small groove means to have a width of approximately 0.125 of an inch at the juncture of said outer end thereof with said open end thereof and a width of approximately 0.046 of an inch at the juncture of said inner end thereof with said open end thereof.

13. A method of making a burner construction as set forth in claim 12 and including the steps of forming each said main groove means to have an open end and a closed end, and forming each said main groove means to have a depth of approximately 0.115 of an inch between said open end and said closed end thereof and to have a width of approximately 0.062 of an inch at said open end thereof.

14. A method of making a burner construction as set forth in claim 11 and including the steps of forming said open end of each said small groove means to define a generally Y-shaped configuration so as to have a generally funnel-shaped outer portion.

15. A method of making a burner construction as set forth in claim 14 and including the step of forming said straight leg inner portion of each said small groove means to have a uniform transverse cross-sectional configuration throughout the length thereof.

16. A method of making a burner construction as set forth in claim 15 and including the step of forming said uniform transverse cross-sectional configuration to be a substantially U-shape and thereby having an open end and a rounded closed end.

17. A method of making a burner construction as set forth in claim 16 and including the step of forming said straight leg inner portion of each said small groove means to have a width of approximately 0.046 of an inch at said open end thereof and a depth of approximately 0.025 of an inch between said open end and said closed end thereof.

18. A method of making a burner construction as set forth in claim 17 and including the step of forming each said small groove means to have a length of approximately 0.125 of an inch.

19. A method of making a burner construction as set forth in claim 18 and including the step of forming said closed end of said straight leg inner portion of each small groove means to be defined by a radius of approximately 0.023 of an inch.

20. A method of making a burner construction as set forth in claim 11 and including the step of forming each said free end surface means of said land means that are not part of said sets to have only one of said small groove means therein with that said one small groove means being disposed in the center of its respective land means.

* * * * *